US005951409A

United States Patent [19]

Calley

[11] Patent Number: 5,951,409

[45] Date of Patent: Sep. 14, 1999

[54] PERFECT SWING POSITIONER

[76] Inventor: Nicholas O. Calley, P.O. Box 344, Niceville, Fla. 32588

[21] Appl. No.: 09/204,680

[22] Filed: Dec. 3, 1998

[51] Int. Cl.[6] ..... A63B 69/36

[52] U.S. Cl. ..... 473/218; 473/273

[58] Field of Search ..... 473/273, 218, 473/272

[56] References Cited

U.S. PATENT DOCUMENTS

| | | | |
|---|---|---|---|
| 1,922,130 | 8/1933 | Haserodt | 473/273 X |
| 2,886,326 | 5/1959 | Olds | 473/218 |
| 4,257,608 | 3/1981 | Funk | 473/273 X |
| 4,322,084 | 3/1982 | Reece et al. | 273/187 |
| 4,736,952 | 4/1988 | Taft et al. | 273/187 |
| 4,925,192 | 5/1990 | Forbes | 273/187 |
| 5,362,060 | 11/1994 | Hinson | 273/187 |
| 5,616,085 | 4/1997 | LaCoste, Jr. et al. . | |

*Primary Examiner*—George J. Marlo
*Attorney, Agent, or Firm*—Patent & Trademark Services; Joseph H. McGlynn

[57] ABSTRACT

A golf swing training aid which has a base bar to align and position a user's feet in the proper position. A pair of bars are slidably attached to the base bar which allows the user to position the ball properly between his/her feet, to position his/her feet the proper distance apart on every swing, and a vertically telescoping assembly allows the golfer to position the golf ball the proper distance away from the user's body. The pair of bars and the vertically telescoping assembly have indicia thereon viewable through apertures in the base bar so the user will know exactly where to position his/her feet and the ball as well as aligning the clubface properly to the intended target.

5 Claims, 2 Drawing Sheets

PERFECT SWING POSITIONER

BACKGROUND OF THE INVENTION

This invention relates, in general, to a golf training device, and, in particular, to a training device which addresses all the pre-swing variables associated with a proper golf swing.

DESCRIPTION OF THE PRIOR ART

In the prior art various types of golf training devices have been proposed. For example, U.S. Pat. No. 4,322,084 discloses a device for properly orienting the feet of a golfer which comprises indicators which are adjustably fixed to a main frame which positions a golfer's feet in a proper stance.

U.S. Pat. No. 4,736,952 discloses training device which allows a golfer to practice swinging a golf club, which consists of a a U-shaped guide piece with color coded indicia to assist in body, ball and stance positioning. U.S. Pat. No. 4,925,192 discloses a training apparatus which consists of a primary element and three elements secured thereto for locating the feet of a golfer.

U.S. Pat. No. 5,362,060 discloses a stance trainer for golfers which correctly positions the user's feet in relation to a golf ball.

U.S. Pat. No. 5,616,085 discloses a golf swing training device having an elongated stance positioning member and a plurality of discrete placement indicators for positioning a golf ball a selected distance within the golf stance of a golfer.

While the prior art devices achieve their intended purpose, there is a need for a single device which will address all the pre-swing variables incumbent in every golf swing, i.e. alignment, stance, ball position, posture, club face aim, and club grip.

SUMMARY OF THE INVENTION

The present invention comprises a golf swing training aid which comprises a base bar to position a user's feet in the proper position. A pair of bars are slidably attached to the base bar which allows the user to position his/her feet the proper distance apart on every swing, and a vertically telescoping assembly allows the golfer to position the golf ball the proper distance away from the user's body and the proper ball position between the golfer's feet. The pair of bars and thevertically telescoping assembly have indicia thereon so the user will know exactly where to position his/her feet and the ball. Additionally, there are degree calibrations at the end of the telescoping unit which assists in clubface aim and club grip.

It is an object of the present invention to provide a golf training device which will guide a golfer in every aspect of a proper golf swing.

It is an object of the present invention to provide a golf training device which is adjustable to be used by any golfer.

These and other objects and advantages of the present invention will be fully apparent from the following description, when taken in connection with the annexed drawings.

DESCRIPTION OF THE PREFERRED EMBODIMENT

Figure 1:
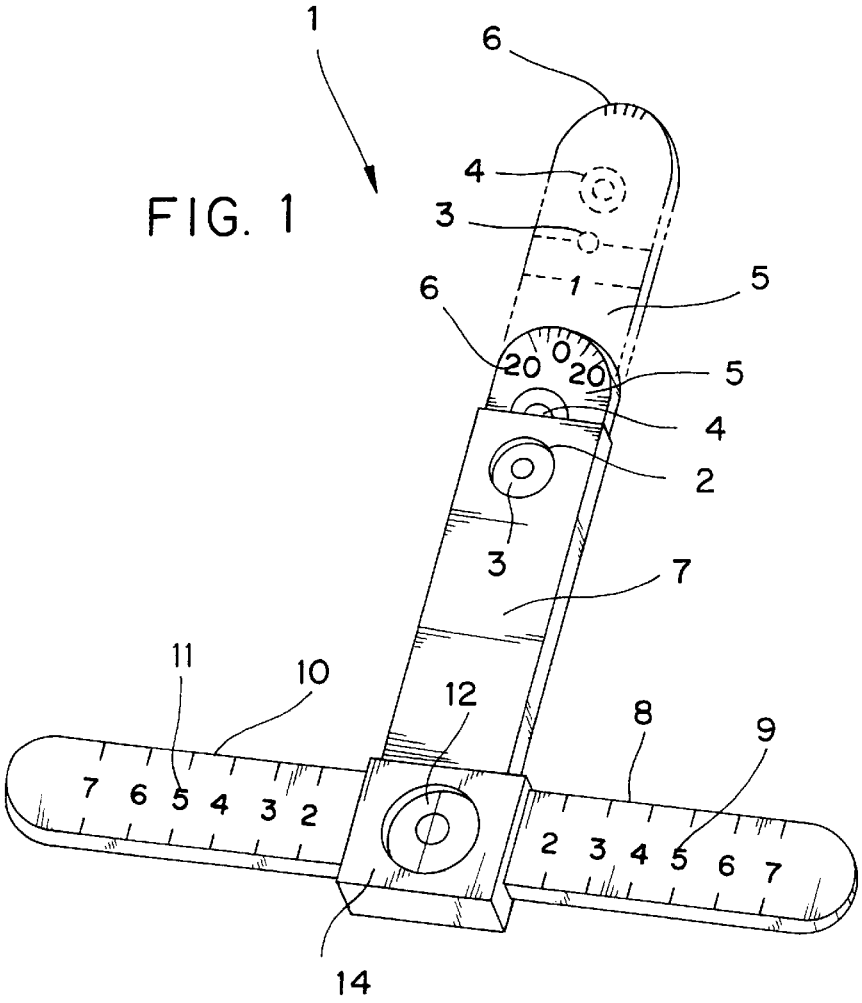
FIG. 1 is a perspective view of the present invention.
Figure 2:
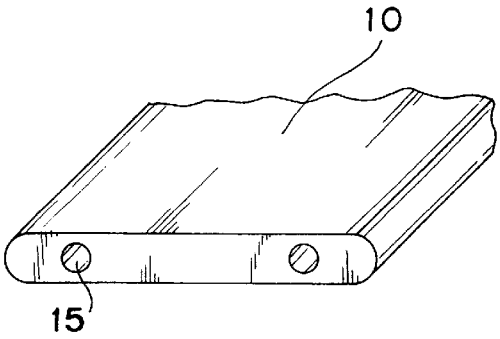
FIG. 2 is a partial end view of one of the feet positioning bars of the present invention.
Figure 3:
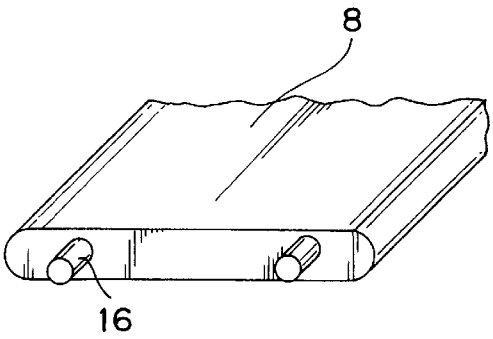
FIG. 3 is a partial end view of the other of the feet positioning bars of the present invention.

Referring now to the drawings in greater detail, FIG. 1 shows the perfect swing positioner 1 of the present invention, which comprises a pair of horizontal base bars 8, 10 which can be secured end to end to each other by means of apertures 15 on the bar 10, and pins 16 on the end of the bar 8. The pins will fit into the apertures with a friction fit to securely fasten the bars 8, 10 to each other (see FIGS. 2 and 3). When the two bars are secured together they will be slid into the aperture 17 (see FIG. 6) on the vertical member 7 and can be moved within the aperture so the user will have a guide as to the proper foot and ball positioning when he/she assumes a stance.

Figures 4, 5, 6:
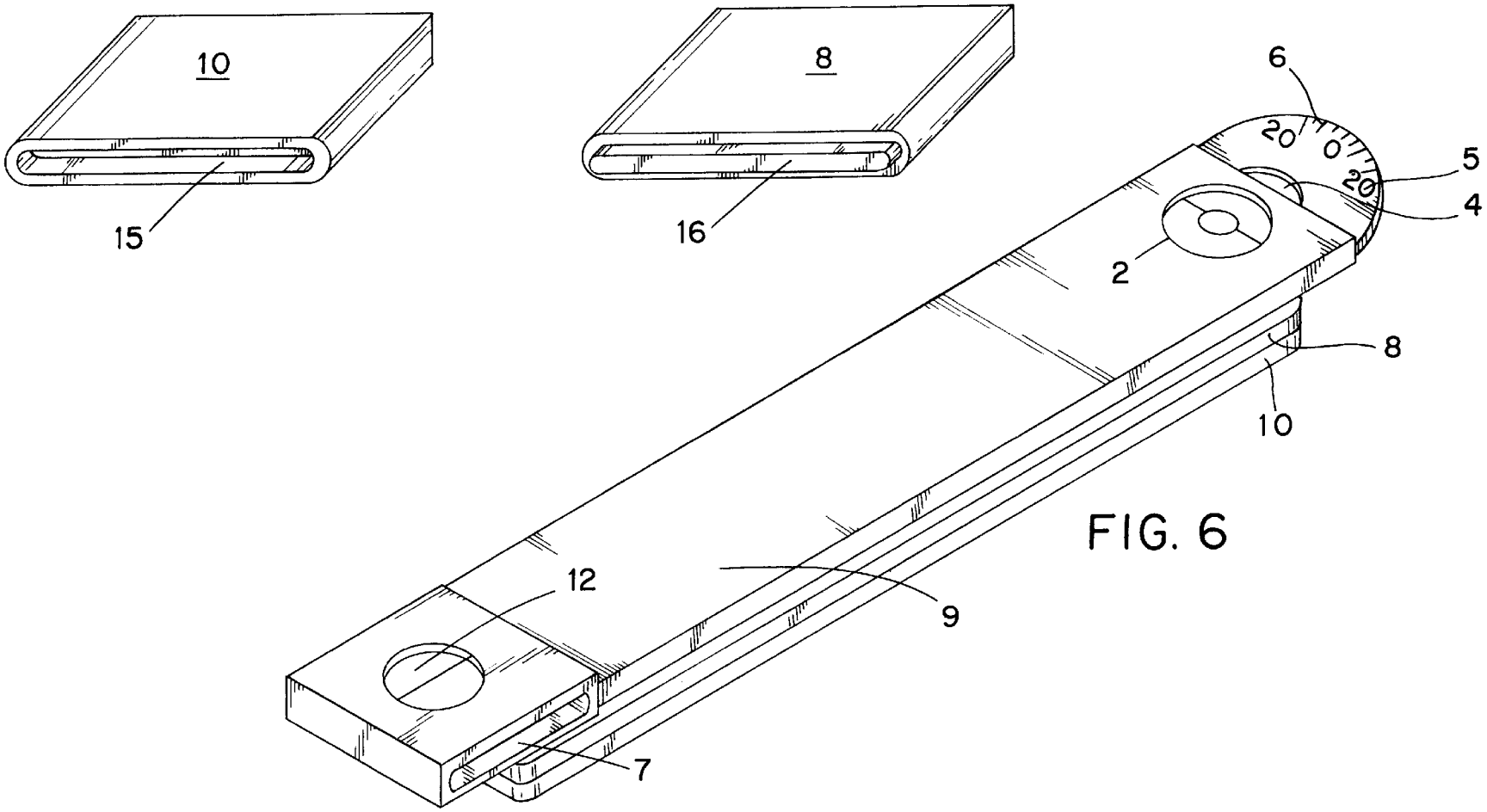
FIG. 4 is a partial end view of another embodiment of one of the feet positioning bars of the present invention.
FIG. 5 is a partial end view of another embodiment of the other of the feet positioning bars of the present invention.
FIG. 6 is a perspective view of the present invention in the disassembled condition.

As can be seen in FIGS. 1 and 6, the base of the vertical member 7 has an aperture 12. The base bars 8, 10 have indicia 9, 11 thereon which will show through the aperture 12. By sliding the base bars to the proper position with respect the vertical member 7 the golfer will know where to position his/her feet using the indicia 9, 11.

For example, a golfer might decide for a particular shot his body should be positioned directly in line with the ball, and therefore, he/she would place the indicator "0" in the middle of aperture 12. Then the user would decide that a portion of the left foot (the tip of the foot, or the front side of the foot for a right handed golfer) would be positioned in line with indicia "5" on the bar 10, and their right foot would be positioned in line with indicia "4" on the bar 8. If the shot was properly made, then the user would know exactly where to position the ball and his feet every time he wanted to make the same shot. This would allow the user to practice making the same shot over and over without worrying about alignment to a target and where to place the ball and/or his feet, and allow him to concentrate on his swing.

In addition, it is sometimes necessary for a golfer to position his body either in front of or behind the ball when making a golf shot. By sliding the bars 8, 10 with respect to the vertical member 7, so that the number "3" on the bar 10 is aligned in the middle of aperture 12 his body will be positioned behind the ball, and he will know exactly how far behind the ball he is and can position their body in exactly the same place while he practices the same shot over and over.

Likewise if he wanted his body in front of the ball he could position the numeral "5" on the bar 8 in the middle of aperture 12, and he will know exactly how far in front of the ball he is and can position his body in exactly the same place while he practices the same shot over and over.

As seen in FIG. 1, the vertical member 7 has an aperture 2 which allows the indicia 3 on the sliding member 5 to show through. The vertical member 7 is hollow and the siding member 5 will slide into (as shown by the solid lines in FIG. 1) and out of the vertical member 7 (as shown by the solid lines in FIG. 1). The indicia 3 on the sliding member 5 will show through the aperture 2 on the vertical member 7 and in this way the user will know exactly how far the tip of the member 5 is out of the hollow vertical member 7. By placing the golf ball (not shown) at the tip of member 5, the golfer will know exactly how far away from his body he placed the golf ball. In this manner the user will know exactly where to position the golf ball and he can then concentrate on other aspects of his swing such as proper positioning of his head, arms and shoulders.

The sliding member 5 has a depression or aperture 4 adjacent one end, and by positioning the end of a golf club in this depression, the user can move the sliding member into or out of the vertical member 7 without bending over. In addition, the tip of the member 5 has indicia 6 positioned thereon to allow the user to "fine tune" the proper positioning of the golf ball and clubface. The indicia range from 30° to 0° to 30° in increments of 5 degrees.

As shown in FIGS. 2–5, the bars 8, 10 and the bars 8', 10' can be secured together end to end by inserting the pins 16 on the bar 8 into the apertures 15 on the bar 10. The pins fit into the apertures with a friction fit to secure the ends of the respective bars together. FIGS. 4 and 5 show an alternative securing means to the pins 16 and the apertures 15. In FIG. 4 the bar 10' has a slot 15' which receives a complimentary shaped projection 16' from the bar 8'. In all other aspects the slot 15' and the complimentary shaped projection 16' operate in the same manner as the pins 16 and the apertures 15.

By making the bars 8, 10 separable, the device can be disassembled, as shown in FIG. 6 and stored in a more compact space such as a car trunk or golf bag.

Distance of the golfer's feet and body from the golf ball is crucial for balance in a golf swing. As with stance and ball position, distance from the golf ball must be exact for a proper swing. Distance from the golf ball will also vary from club to club. The longer the club, the further from the feet and body the ball must be placed. The shorter the club, the closer to the feet and body the ball must be placed. By using the present invention, the golfer may warmup before a round or practice different golf shots or practice using different golf clubs without worrying where to place the ball and/or his feet, and allow him to concentrate on his swing. The golfer may place his toes against the bottom part of 8, 10 or he may place his heels against the top part of 8, 10.

Also, it should be noted that while the indicia 9, 11 on the bars 8, 10 and the indicia 3, 6 on the sliding member 5 are shown as numerals, this is merely for illustration purposes, and other indicia such as the indicia 6' in FIG. 6 can be used without departing from the scope of the invention.

Although the Perfect Swing Positioner and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A device for use as an instructional aid in golf, comprising:

first and second bar members, said bar members being detachably secured to each other, means for holding said first and second bar members in fixed relationship to each other, each of said bar members having indicia thereon, a third bar member having means for receiving said first and second bar members, aperture means for allowing said indicia on said first and second bar members to be displayed through said third bar member, a fourth bar member adjustably secured to said third bar member, indicia on said fourth bar member, said third bar member having a second aperture means for allowing said indicia on said fourth bar member to be displayed through said third bar member.

2. The device for use as an instructional aid in golf as claimed in claim 1, wherein said first and second bar members are detachably secured to each other by means of at least one projection on one of said first and second bar members, and at least one aperture on one of said first and second bar members.

3. The device for use as an instructional aid in golf as claimed in claim 1, wherein said third bar member is hollow, and said fourth bar member is slidably received within said hollow.

4. The device for use as an instructional aid in golf as claimed in claim 1, wherein said fourth bar member has a depression adjacent one end.

5. The device for use as an instructional aid in golf as claimed in claim 1, wherein said means on said third bar member for receiving said first and second bar members is an aperture which extends through said third bar member.

* * * * *